US005207317A

United States Patent [19]

Bryde et al.

[11] Patent Number: 5,207,317

[45] Date of Patent: May 4, 1993

[54] SNAP-ACTION SWITCH ACTUATOR

[75] Inventors: Gary W. Bryde, Catasauqua; James E. Swain, III, Bethelem; John R. Woodman, Cooperburg, all of Pa.

[73] Assignee: Lutron Electronics Co., Inc., Coopersburg, Pa.

[21] Appl. No.: 860,922

[22] Filed: Mar. 31, 1992

[51] Int. Cl.[5] ..... H01H 5/06

[52] U.S. Cl. ..... 200/457; 200/339; 200/458

[58] Field of Search ..... 200/452, 454, 457, 458, 200/339

[56] References Cited

U.S. PATENT DOCUMENTS

| | | | |
|---|---|---|---|
| 1,943,363 | 1/1934 | Bain et al. | 200/457 |
| 2,685,007 | 7/1954 | Fischer | 200/458 |
| 2,924,692 | 2/1960 | Campe et al. | 200/457 |
| 3,471,670 | 10/1969 | Norden | 200/339 |
| 3,770,920 | 11/1973 | Pollak | 200/457 |
| 4,095,066 | 6/1978 | Harris | 200/458 |

FOREIGN PATENT DOCUMENTS

| | | | |
|---|---|---|---|
| 891331 | 3/1962 | United Kingdom | 200/457 |

*Primary Examiner*—Renee S. Luebke
*Attorney, Agent, or Firm*—Warren W. Kurz

[57] ABSTRACT

A switch actuator having a bezel, paddle and spring-biased lever. The bezel has a pivot defining a first pivot axis and an outer surface defining a plane. The paddle has an outer surface and an inner surface facing in a direction opposite the outer surface. The inner surface has structure for actuating a switch in response to actuation of the paddle, which is pivotably supported in the bezel for limited pivoting movement about the first pivot axis between first and second positions. A lever is pivotably mounted on the bezel and disposed at an acute angle to said plane. The lever is pivotable with respect to the bezel and the paddle about a second pivot axis as the paddle is pivoted about the first pivot axis. The second pivot axis is spaced from and substantially parallel to the first pivot axis. A spring is disposed at an acute angle to the plane. A first end of the spring is received by a spring receiver on the paddle inner surface and a second end of the spring is received by a spring receiver on the lever. The spring is spaced a distance from the second pivot axis and positioned between the second pivot axis and the spring receiver on the lever. The spring biases the paddle to the first position as it is operated toward the second position until approximately a midpoint of movement of the paddle, and thereafter biases the paddle to the second position.

16 Claims, 4 Drawing Sheets

SNAP-ACTION SWITCH ACTUATOR

FIELD OF THE INVENTION

The present invention relates to a rocker-type snap-action actuator for an electrical switch.

BACKGROUND OF THE INVENTION

Rocker switches for electrical circuits, particularly wall switches for electric lights, are known. One example of a known rocker-type wall switch is disclosed in U.S. Pat. No. 3,770,920. In that design, the rocker paddle has limited pivoting movement about an axis parallel to the wall in which the switch is mounted. When the switch is operated, the pivotable rocker paddle tilts a coil spring relative to the plane of a pivoted contact-carrying brush, and moves the lower end of the brush into or out of engagement with fixed contacts. Cams on the rocker paddle are also urged into engagement with the pivoted brush by the coil spring. The cams hold the lower end of the brush in engagement with one of the fixed contacts under pressure from the spring. The spring additionally acts to cause the rocker paddle and brush to snap into position either into or out of engagement with the contacts without further effort by the user once the rocker paddle is moved to just past its midpoint.

This type of switch has been in widespread use in electrical wall switches for many years. However, it does have some disadvantages. One disadvantage is that this type of design requires substantial depth behind the wall plate to accommodate the coil spring and the contact-carrying brush. This takes up valuable space when this type of switch is used in a conventional wall box, which in turn limits the space available for other circuitry, such as dimming circuitry or other control circuitry, in the wall box.

There is a need for a rocker-type switch which can be operated in response to light finger pressure, operates with limited pivoting movement to keep the switch substantially flush with a wall plate so that it will not protrude objectionably from the wall plate, consumes almost no space beyond the space consumed by the switch paddle itself, and provides tactile feedback, or a balanced operating "feel, " to the user. The present invention fills that need.

SUMMARY OF THE INVENTION

The present invention is directed to a switch actuator comprising a bezel having pivot means thereon defining a first pivot axis, said bezel having an outer surface defining a plane, a paddle having an outer surface for operating said paddle and an inner surface facing in a direction opposite said outer surface, said inner surface having means thereon for causing a switch means to be actuated in response to actuation of said paddle, said paddle being pivotably supported in said bezel for limited pivoting movement about said first pivot axis between a first position and a second position, lever means pivotably mounted on said bezel and disposed at an acute angle not greater than 45° to said plane, said lever means being pivotable with respect to said bezel and said paddle about a second pivot axis as said paddle is pivoted about said first pivot axis, said second pivot axis being spaced from and substantially parallel to said first pivot axis, and spring means disposed at an acute angle not greater than 45° to said plane, a first end of said spring being received by spring receiving means disposed on said paddle inner surface and a second end of said spring being received by spring receiving means disposed on said lever means, said spring means being spaced a distance from said second pivot axis and positioned between said second pivot axis and said spring receiving means on said lever means for biasing said paddle means to said first position as said paddle means is operated toward said second position until approximately a midpoint of said pivoting movement of said paddle and thereafter biasing said paddle means to said second position.

DESCRIPTION OF THE DRAWINGS

For the purpose of illustrating the invention, there is shown in the drawings a form which is presently preferred; it being understood, however, that this invention is not limited to the precise arrangement and instrumentalities shown.

DESCRIPTION OF THE INVENTION

Figure 1:
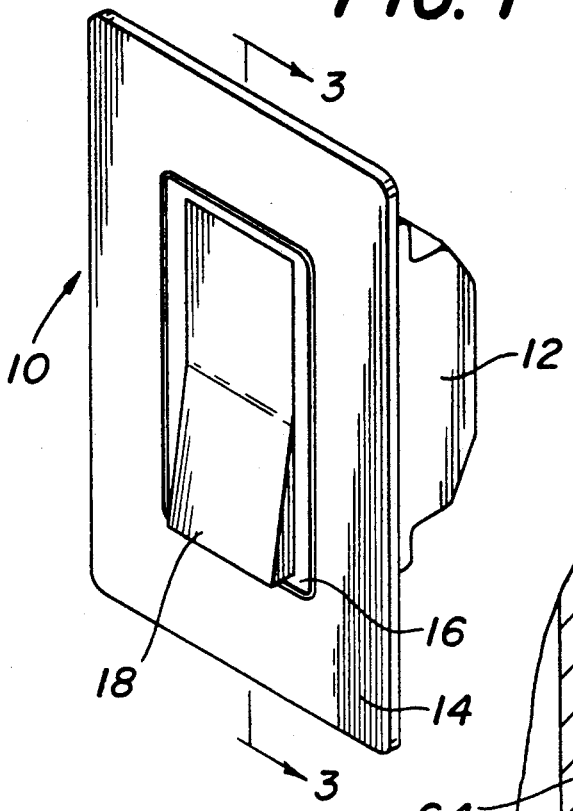
FIG. 1 is a perspective view of a wall switch including a switch actuator according to the present invention.
Figure 6:
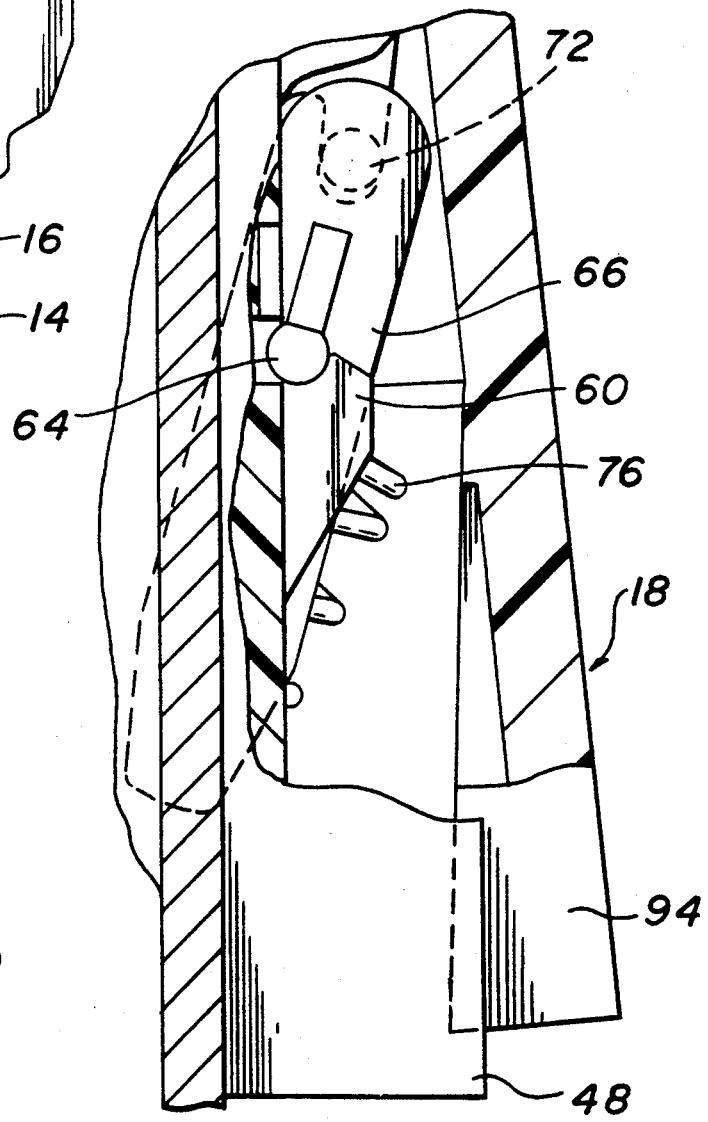
FIG. 6 is an enlarged simplified sectional view taken along the line 6—6 in FIG. 5.

Referring now to the drawings, wherein like numerals indicate like elements, there is shown in FIG. 1 a wall switch 10 incorporating a snap-action switch actuator according to the present invention. Wall switch 10 comprises a back cover 12, a face plate 14, a bezel 16 and a paddle 18. Bezel 16 is received in a corresponding opening in face plate 14, in known manner. Back cover 12 and face plate 14 may be conventional, but in any case the details of back cover 12 and face plate 14 are not crucial to the present invention and need not be described further.

Figure 2:
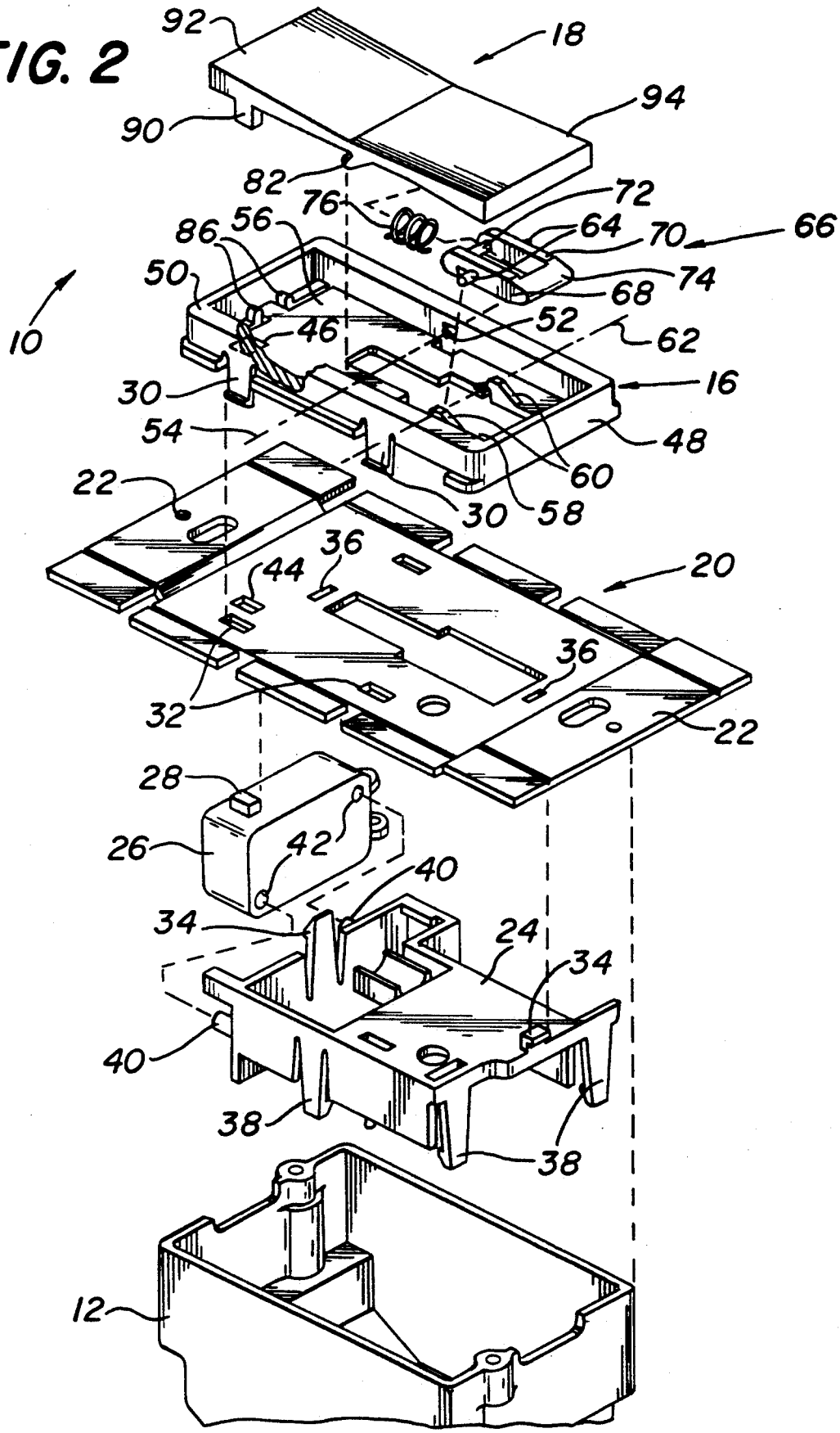
FIG. 2 is an exploded view of the wall switch of FIG. 1, showing the various elements of one embodiment of the invention and their relationship to other parts of the wall switch.

The internal operating components of the present invention are best seen in the exploded view of FIG. 2. In FIG. 2, face plate 14, and many of the details not necessary to understand and illustrate the invention, have been omitted for the sake of clarity. As seen in FIG. 2, bezel 16 is mounted on a yoke 20, which is located behind face plate 14 and which is essentially conventional. Thus, yoke 20 may include, for example, threaded openings 22 by which a conventional face plate 14 may be attached by screws to wall switch 10, in the usual manner. (Alternatively, a snap-on face plate 14, which mounts to yoke 20 without screws, may be used.) Yoke 20 also supports a platform 24 on which may be mounted electrical and/or electronic circuitry such as dimming circuitry or the like. Platform 24, in addition to circuitry, supports a microswitch 26, having a plunger 28 which is to be actuated by paddle 18, as will be described in greater detail below.

Bezel 16 may be attached to yoke 22 in any convenient manner. In the illustrated embodiment, bezel 16 is preferably formed as a single piece and is provided with integral tabs 30 which snap into corresponding openings 32 in yoke 20. This manner of attaching bezel 16 to yoke 20 is well known. Similarly, platform 24 is also preferably formed as a single piece and is provided with integral tabs 34 which snap into corresponding openings 36 in yoke 20. Platform 24 may further be provided with additional integral tabs 38 to support a printed circuit board (not shown). Backcover 12 may be attached to yoke 20 in any conventional manner.

Platform 24 is also preferably provided with locating pins 40 which are received in corresponding locating holes 42 in microswitch 26, thus enabling microswitch 26 to be attached to platform 24 as desired.

Plunger 28 of microswitch 26 projects through a corresponding opening 44 in yoke 20. Bezel 16 is also provided with an opening 46 in registry with opening 44 in yoke 20, in order to accommodate switches having plungers of different lengths and to enable plunger 28 to be actuated by paddle 18, as will be described in more detail below.

Bezel 16 has a peripheral wall 48 which extends around substantially the entire periphery of bezel 16. Wall 48 has an outer surface 50 which substantially defines an imaginary plane. Projecting from oppositely-facing inner surfaces of wall 48 are a pair of stub axles 52, which together define a pivot axis 54. Bezel 16 further includes a floor 56 in which is provided an opening 58 to accommodate components of the switching mechanism to be described below. Floor 56 supports a pair of projections 60 on opposite sides of opening 58. Projections 60 together define a second pivot axis 62.

Projections 60 are configured to receive therein stub axles 64 on lever 66. Lever 66 has transverse dimensions less than the transverse dimension of opening 58 in bezel 16, so that lever 66 is pivotable about axis 62 with respect to bezel 16.

Figure 3:
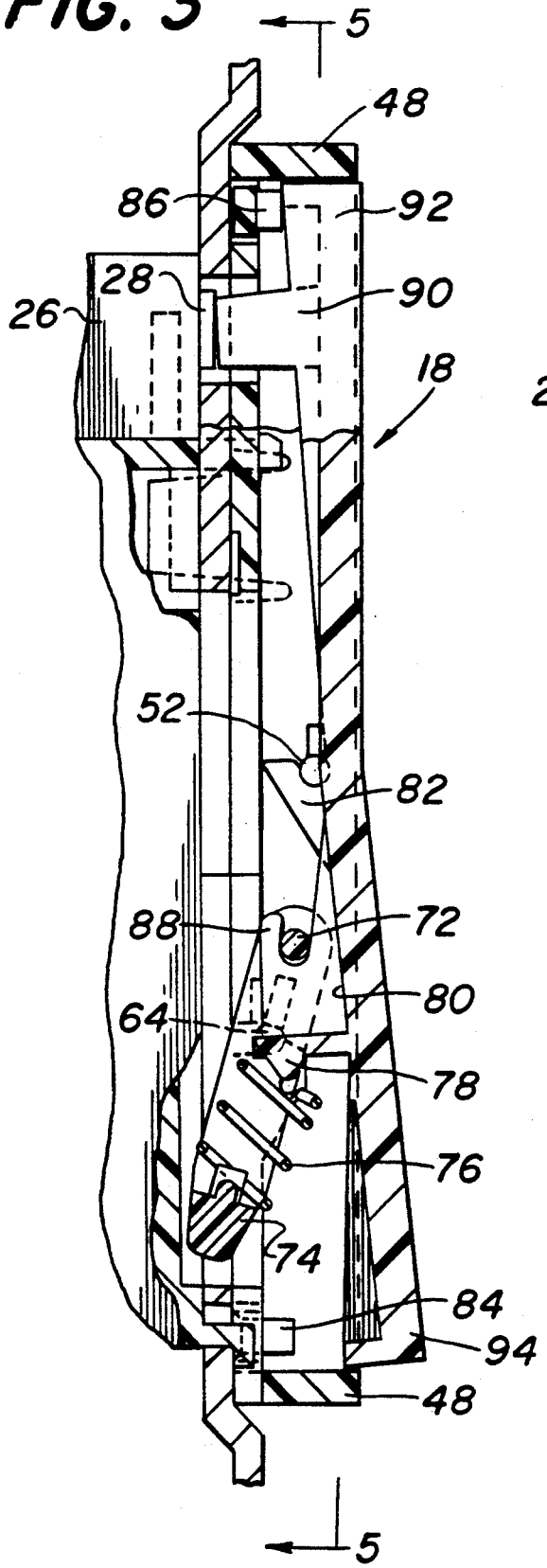
FIG. 3 is a simplified sectional view of the switch actuator portion of the wall switch shown in FIG. 1 taken along the section line 3—3.
Figure 4:
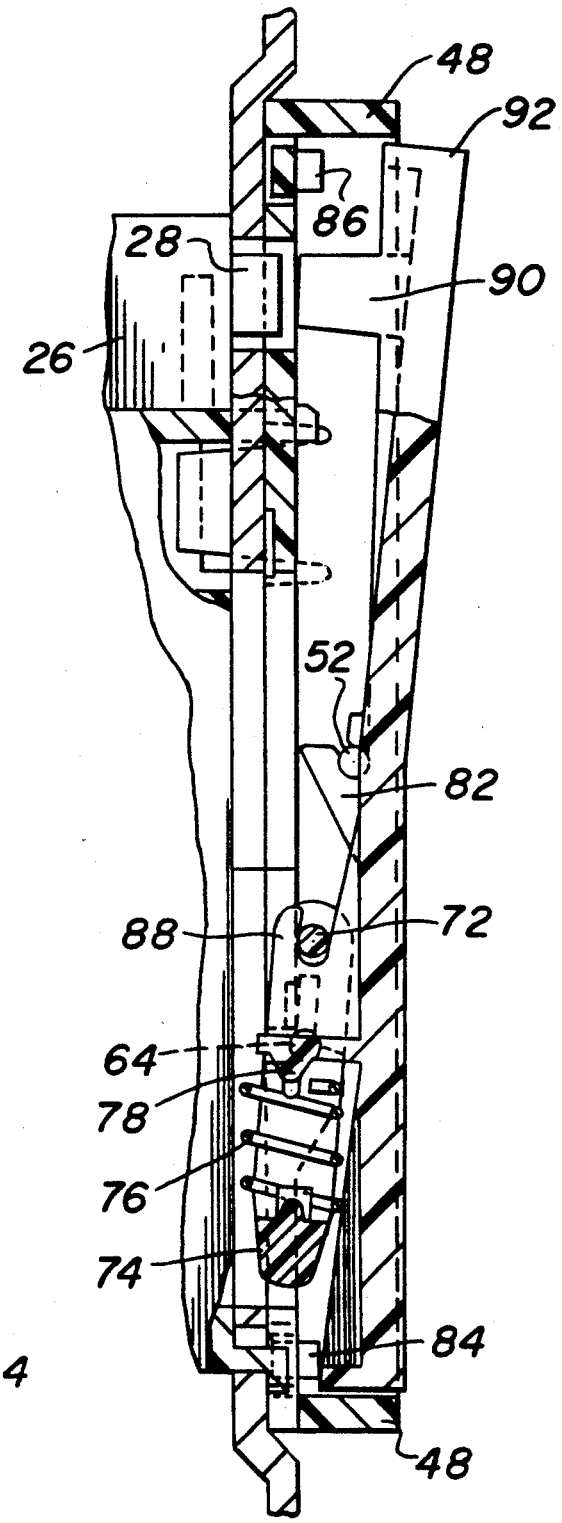
FIG. 4 is a simplified sectional view of the FIG. 1 wall switch showing the switch-actuator in a de-actuating position.

Preferably, lever 66 is in the form of a clevis, having parallel arms 68 and 70. A rod 72 extends between respective first ends of arms 68 and 70, and between respective opposite ends of arms 68 and 70 is located a spring receiver 74 for receiving and retaining one end of a spring 76. Spring 76 is preferably, but need not be, a coil spring. The opposite end of spring 76 engages a spring receiver 78 on the inner surface 80 of paddle 18. This is illustrated in FIGS. 3 and 4. Spring 76 is thus constrained to move between spring receiver 74 on lever 66 and spring receiver 78 on paddle 18.

Paddle 18 is pivotably mounted on stub axles 52 of bezel 16 for pivotable movement about axis 54. For this purpose, paddle 18 is provided on its inner surface 80 with a pair of depending arms 82 each having a semicircular recess for pivotably receiving stub axles 52 therein. Bezel 16 is provided with cantilever arm-mounted limit stops 84 and 86 to limit pivoting movement of paddle 18 to a range between first and second positions corresponding to first and second switch states. Cantilever arm-mounted limit stops 84 and 86 are displaceable for a short distance with respect to floor 56 of bezel 16, and are displaceable for ease of insertion of paddle 18 into bezel 16 during assembly.

Figure 5:
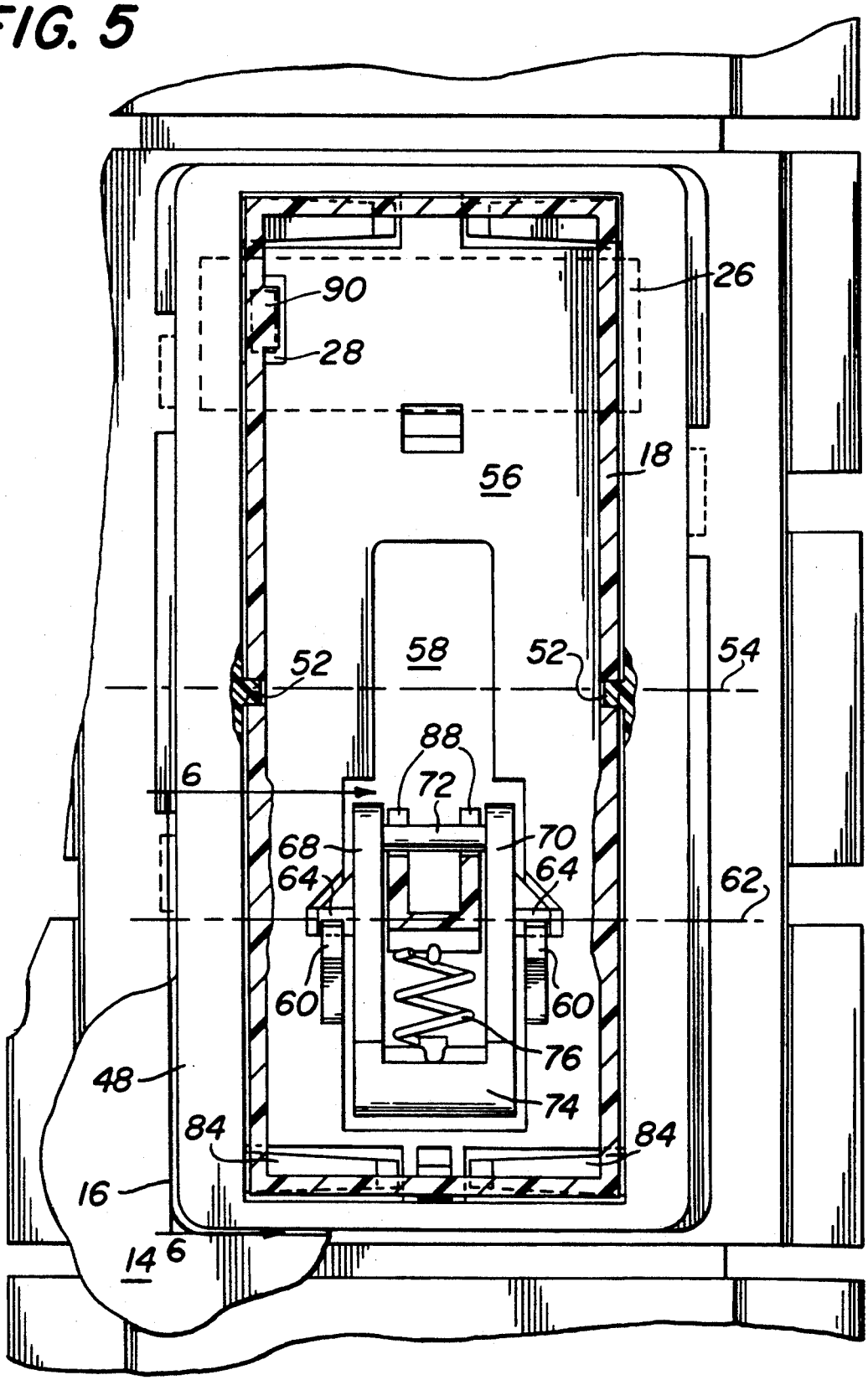
FIG. 5 is a simplified sectional view taken along the line 5—5 in FIG. 3.

Paddle 18 is also provided on its inner surface 80 with a pair of depending arms 88 each of which has an elongated recess therein for pivotably receiving rod 72 of lever 66, as can best be seen in FIG. 5. Pivoting movement of paddle 18 about axis 54 causes movement of depending arms 88, which transmit the movement of paddle 18 to rod 72 of lever 66, thus causing pivoting movement of lever 66 about axis 62.

As best illustrated in FIGS. 3 and 4, paddle 18 is further provided with a depending tab 90 in registry with opening 46 in bezel 16 and opening 44 in yoke 20, so that tab 90 makes contact with switch plunger 28 when microswitch 26 is to be actuated and breaks contact with switch plunger 28 when microswitch 26 is to be de-actuated.

Paddle 18 may be of any suitable shape as long as paddle 18 has two opposite ends 92 and 94 by which it can be actuated by a user. That is, ends 92 and 94 permit a user to manually apply pressure to paddle 18 to cause it to pivot about axis 54. The outer surface of paddle 18 may be substantially planar, or may be in the form of flat angularly-disposed planes which intersect at the center of paddle 18, as shown in the figures. In addition, the dimensions of paddle 18 are not critical, and paddle 18 may be of any convenient dimensions.

To assemble paddle 18, lever 66 and spring 76 to bezel 16, paddle 18 is orientated with its inner surface 80 facing floor 56 of bezel 16. Rod 72 of lever 66 is inserted into the elongated recess on depending arms 88 on inner surface 80 of paddle 18. One end of spring 76 is placed on spring receiver 78 on paddle 18. Lever 66 is rotated toward spring 76 and the other end of spring 76 is placed on spring receiver 74 of lever 66. Rotation of lever 66 is continued until lever 66 rests against inner surface 80 of paddle 18. The end of spring 76 received in spring receiver 78 will seat in position as lever 66 is being rotated. This compresses spring 76 with sufficient force to retain lever 66 and spring 76 against inner surface 80 of paddle 18.

Paddle 18 is then inserted into bezel 16 so that the semicircular recesses in depending arms 82 engage stub axles 52 on bezel wall 48. During insertion, paddle 18 deflects the cantilever arm-mounted limit stops 86, allowing paddle 18 to rotate farther than during normal operational rotation. Then, paddle 18 is rotated back toward its normal operating position, causing stub axles 64 on lever 66 to snap into position under projections 60 on bezel 16. Paddle 18 is now in a first operating position. Rotating paddle 18 back again in the opposite direction, toward its second operating position, pulls lever 66 away from paddle 18, freeing paddle 18 and lever 66 for normal operation. This completes assembly, and one of the two ends 92, 94 of paddle 18 extends past bezel wall 48. For purposes of illustrating the invention, end 92 extends past the bezel wall.

Operation of the assembled device will now be described. To actuate the wall switch 10, extending end 92 is depressed by a user. Depression of end 92 causes paddle 18 to pivotably rotate about axis 54. This movement of paddle 18 causes lever 66 to also pivotably rotate, due to the action of arms 88 on rod 72 of lever 66. Lever 66 rotates about axis 62. As paddle 18 and lever 66 rotate about their respective axes, spring receiver 74 on lever 66 and spring receiver 78 on paddle 18 will move relative to one another. The relative motion of spring receivers 74 and 78 causes spring 76 to first compress, then extend, as paddle 18 is rotated. Compression of spring 76 at first causes paddle 18 to resist the rotation, and biases paddle 18 toward its initial position. However, as the user continues to depress paddle 18 and causes it to continue to rotate, spring 76 will extend as the midpoint of rotation is reached, and will snap paddle 18 into the opposite position without any further effort by the user. Spring 76 then biases paddle 18 into that position until paddle 18 is rotated back toward the initial position, when the sequence of events described above is repeated.

The actuator mechanism described is entirely self-contained, and has a very shallow profile which does not intrude into the interior of the wall box. In addition, the actuator mechanism may be assembled remotely from the remainder of the wall switch and attached to it at any later time, either in the factory or in the field. This allows a great degree of flexibility in choosing colors or finishes, which is an important consideration in many cases where the actuator of the invention will be used.

It should be understood that many modifications to the various parts of the invention may be made without departing therefrom. For example, any style or type of wall plate may be used with the invention, and microswitch 26 is not the only type of switch that may be actuated by paddle 18. Moreover, microswitch 26 need not be directly actuated by tab 90 on paddle 18, but may be indirectly actuated by an intermediate mechanism or linkage.

Figure 7:
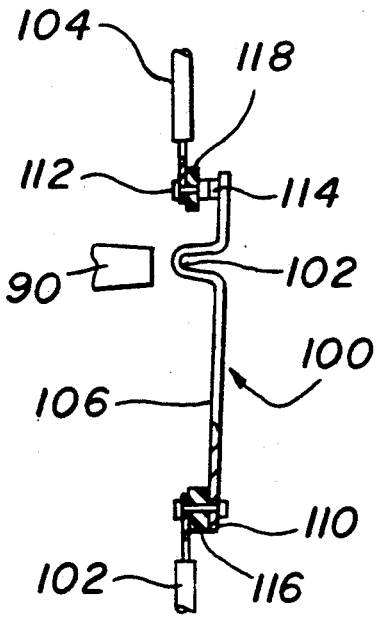
FIG. 7 is an elevational view of a leaf switch mechanism which can be used with the invention.

An alternate type of switch which may be actuated by paddle 18 is illustrated in FIG. 7. This is a simple, low cost leaf switch 100 having a fixed contact 112 and a movable contact 114. Wire 104 is connected directly to contact 112. Wire 102 is connected to contact 114 via rivet 110 and leaf spring 106. Leaf spring 106 biases contact 114 into connection with contact 112, thus completing the circuit between wires 102 and 104, when no external force is applied to leaf spring 106.

However, an external force can be applied to bend 108 in leaf spring 106, by tab 90 of paddle 18, forcing contact 114 away from contact 112 and breaking the circuit between wires 102 and 104.

Contacts 112, 114, leaf spring 106 and rivet 110 are made of electrically conductive material. Support means 116 for leaf spring 106 and 118 for fixed contact 112 are made of electrically insulating material and are preferably an integral part of platform 24.

Spring 76 need not be a coil spring, but may be a leaf spring or any other suitable spring, or it could be an integral part of lever 66. Many other modifications may also suggest themselves to those skilled in the art, and it should be understood that the preferred embodiment of the invention described herein is illustrative only and does not limit the invention to the precise structure shown.

The present invention may be embodied in other specific forms without departing from the spirit or essential attributes thereof and, accordingly, reference should be made to the appended claims, rather than to the foregoing specification, as indicating the scope of the invention.

We claim:

1. A switch actuator for actuating a switch means comprising a bezel having pivot means thereon defining a first pivot axis, said bezel having an outer surface defining a plane, a paddle having an outer surface for operating said paddle and an inner surface facing in a direction opposite said outer surface, said inner surface having means thereon for causing a switch means to be actuated in response to actuation of said paddle, said paddle being pivotably supported in said bezel for limited pivoting movement about said first pivot axis between a first position and a second position, lever means pivotably mounted on said bezel and disposed at an acute angle not greater than 45° to said plane, said lever means being pivotable with respect to said bezel and said paddle about a second pivot axis as said paddle is pivoted about said first pivot axis, said second pivot axis being spaced from and substantially parallel to said first pivot axis, and spring means disposed at an acute angle not greater than 45° to said plane, a first end of said spring being received by spring receiving means disposed on said paddle inner surface and a second end of said spring being received by spring receiving means disposed on said lever means, said spring means being spaced a distance from said second pivot axis and positioned between said second pivot axis and said spring receiving means on said lever means for biasing said paddle means to said first position as said paddle means is operated toward said second position until approximately a midpoint of said pivoting movement of said paddle and thereafter biasing said paddle means to said second position.

2. A switch actuator as in claim 1, wherein said spring means biases said paddle means to said second position as said paddle means is operated toward said first position until approximately a midpoint of said pivoting movement of said paddle means and thereafter biases said paddle means to said first position.

3. A switch actuator as in claim 1, wherein said paddle outer surface comprises angularly disposed portions which diverge from each other at an obtuse angle.

4. A switch actuator as in claim 1, wherein said paddle has a first end which projects beyond said plane when said paddle is in said first position and a second end which projects beyond said plane when said paddle is in said second position.

5. A switch actuator as in claim 1, wherein said spring means comprises a coil spring.

6. A switch actuator as in claim 1, wherein said switch means is a microswitch.

7. A switch actuator as in claim 1, wherein said switch means is a leaf switch.

8. In a wall switch having a backcover open along a surface thereof, a yoke mounted on said backcover adjacent and coplanar with said surface, and a substantially planar face plate mounted on said yoke on a side of said yoke opposite said backcover, said yoke including means associated therewith for supporting a switch actuator, a low-profile switch actuator comprising a bezel supported by said yoke, said bezel having a predetermined depth and pivot means thereon defining a first pivot axis, said bezel having an outer surface defining a plane substantially parallel to said face plate, said bezel being substantially between said face plate and said yoke and entirely on the side of said yoke opposite said backcover, said bezel having a shallow depth between said plane and said yoke.

a paddle having an outer surface for operating said paddle and an inner surface facing in a direction opposite said outer surface, said inner surface having means thereon for causing a switch means to be actuated in response to actuation of said paddle, said paddle being pivotably supported in said bezel for limited pivoting movement about said first pivot axis between a first position and a second position, a portion of said paddle protruding past said plane, said paddle being entirely on the side of said yoke opposite said backcover, lever means pivotably mounted on said bezel and disposed at an acute angle to said plane, said lever means being pivotable with respect to said bezel and said paddle about a second pivot axis as said paddle is pivoted about said first pivot axis, said second pivot axis being spaced from and substantially parallel to said first pivot axis, and spring means resiliently connecting said paddle means and said lever means, a first end of said spring being received by spring receiving means disposed on said paddle inner surface and a second end of said spring being received by spring receiving means disposed on said lever means, said spring means being spaced a distance from said second pivot axis and positioned between said second pivot axis and said spring receiving means on said lever means for biasing said paddle means to said first position as said paddle means is operated toward said second position until approximately a midpoint of said pivoting movement of said paddle and thereafter biasing said paddle means to said second position, whereby the entire range of movement of said switch actuator occurs substantially within a distance not exceeding the depth of said bezel.

9. A low profile switch actuator as in claim 8, wherein said spring means biases said paddle means to said second position as said paddle means is operated toward said first position until approximately a midpoint of said pivoting movement of said paddle means and thereafter biases said paddle means to said first position.

10. A low profile switch actuator as in claim 8, wherein said switch means is a microswitch.

11. A low profile switch actuator as in claim 8, wherein said switch means is a leaf switch.

12. An electrical switch actuator comprising:

a bezel;

a paddle pivotally supported by said bezel for limited pivotal movement between first and second positions about a first pivot axis, said paddle having means thereon for causing the actuation of a switch during pivotal movement of said paddle between its first and second positions;

a lever pivotally supported by said bezel for limited pivotal movement between first and second positions about a second pivot axis spaced from said first pivot axis;

means operatively coupling said lever and paddle such that pivotal movement of said paddle effects pivotal movement of said lever; and a spring operatively coupling said paddle and lever, said spring operating to bias said paddle and lever towards their respective first positions until said paddle is caused to pivot a predetermined distance towards its second position, whereupon said spring operates to bias said paddle and lever towards their respective second positions.

13. The switch actuator as in claim 12 wherein said spring further operates to bias said paddle and lever towards their respective second positions until said paddle is caused to pivot a predetermined distance towards its first position, whereupon said spring operates to bias said paddle and lever towards their respective first positions.

14. The switch actuator as in claim 12 wherein said spring is a coil spring.

15. The switch actuator as in claim 12 wherein said switch is a microswitch.

16. The switch actuator as in claim 12 wherein said switch is a leaf switch.

* * * * *